US005926857A

United States Patent [19]

Blondeau

[11] Patent Number: 5,926,857

[45] Date of Patent: Jul. 27, 1999

[54] ARMOR WITH ROLLERS

[76] Inventor: Jean-Yves Blondeau, Les Prérus, F-73410 Albens, France

[21] Appl. No.: 08/952,611

[22] PCT Filed: May 31, 1996

[86] PCT No.: PCT/FR96/00829

§ 371 Date: Nov. 24, 1997

§ 102(e) Date: Nov. 24, 1997

[87] PCT Pub. No.: WO96/38208

PCT Pub. Date: Dec. 5, 1996

[30] Foreign Application Priority Data

Jun. 1, 1995 [FR] France ..... 95/06510

[51] Int. Cl.[6] ..... G21F 3/02; A41D 13/00

[52] U.S. Cl. ..... 2/456; 2/463; 2/467; 2/16; 2/22; 280/11.19

[58] Field of Search ..... 2/455, 456, 463, 2/464, 467, 16, 22, 23, 24, 69, 102, 158, 159, 160; 280/32.5, 32.6, 7.15, 11.19, 7.11, 87.021, 87.01, 87.03, 87.041

[56] References Cited

U.S. PATENT DOCUMENTS

| | | | |
|---|---|---|---|
| 4,413,832 | 11/1983 | Pendleton . | |
| 5,373,584 | 12/1994 | Parcells, III . | |
| 5,427,391 | 6/1995 | Cooper | 280/11.19 |
| 5,725,224 | 3/1998 | Kerr | 280/11.19 |

FOREIGN PATENT DOCUMENTS

| | | |
|---|---|---|
| 515715 | 1/1972 | Switzerland . |
| WO 92/22275 | 12/1992 | WIPO . |

*Primary Examiner*—John J. Calvert
*Assistant Examiner*—Larry D. Worrell, Jr.
*Attorney, Agent, or Firm*—Oliff & Berridge, PLC

[57] ABSTRACT

An armor with rollers is provided that enables a user to move in all positions by rolling on a hard and smooth surface while constantly varying his bearing points on the ground. The armor includes a pair of gauntlets extending from beyond the user's hand to the user's elbow and having rollers at both ends thereof. The armor also includes a pair of rigid leg pads having rollers near the user's knees.

14 Claims, 2 Drawing Sheets

ARMOR WITH ROLLERS

BACKGROUND OF THE INVENTION

1. Field of the Invention

The present invention relates to an armor with rollers enabling a user to move in all positions by rolling on a hard and smooth surface.

2. Description of Related Art

Over the last few years we have witnessed a rapid development of sports involving "sliding" such as snow surfing, skateboarding, acrobatic skiing, windsurfing etc. all derived from conventional skiing or ice or roller skating. These new activities which are meeting with increasing success, notably with a young audience eager for thrills, are based on the search for high speed associated with an instantaneous balance by means of quick movements having the consequence of continually shifting the center of gravity of the body.

When a person performs these activities, he takes advantage of an energy potential arising from rolling or sliding on water, snow or ground, either sloping or not, or from the air or waves, while in the vast majority of cases being able to use his feet only for support.

SUMMARY OF THE INVENTION

The object of the present invention is to propose a new sport involving skill and speed in which the user can move at high speed by rolling on the ground and/or any hard and smooth surface in all positions while constantly varying his bearing points.

To achieve this, the invention relates to an armor with rollers enabling movement on a hard and smooth surface, characterized in that it is comprised of an assembly of rigid holding parts fitted with rollers designed to be fixed to the members and/or trunk of the user.

It should be noted that these holding parts in fact have a dual purpose consisting on the one hand in enabling the rollers to be fitted and on the other hand in providing protection of the user's body and members.

These different holding parts must be made of a sufficiently rigid material such as, for example, a moulded thermohardening resin. It is naturally necessary to equip these parts with articulations and closing elements enabling the user to "get into them" and fix them to his body; these articulations and these parts can be of any nature without departing from the scope of the invention.

For the armor with rollers according to the invention to be of a nature to give satisfaction, it is in addition necessary to design the protective parts in such a way that they can form a block with the user's trunk or members and to provide them with a sufficient number of rollers to enable the user to move in all positions and in all directions by rolling.

According to a preferred feature of the invention, the set of holding parts comprises:

- a pair of gauntlets extending up to the user's arm and equipped with rollers on the one hand at their external end situated beyond the hand and on the other hand at the level of the elbow joint,
- a pair of leg-pads equipped with rollers at the level of the knee joint and,
- a pair of shoes fitted with roller skates.

The rollers situated at the level of the knee and elbow joints are preferably grouped in pairs and fitted around a common rotation axis so as to provide a sufficiently stable support.

To leave the user sufficient freedom of movement, the gauntlets must naturally be articulated at the elbow. It is also advantageous for them to be provided with an opening for gripping at the level of the hand to enable the user to grasp objects.

The leg-pads are for their part preferably articulated on the shoes on which the roller skates are fitted which skates can be of conventional or in-line type. It may also prove advantageous to provide complementary rollers at the front part of the shoes at the level of the user's toes and/or at the rear part of the shoes at the level of the heel.

These complementary rollers can naturally be single or grouped in pairs.

On account of the above-mentioned configuration, the user having put on the armor with rollers according to the invention, can start his run standing up as on roller skates, then kneel down placing one knee on the ground followed by his hands, then both knees, and move in this position before getting up by performing the reverse movements.

According to another preferred feature of the invention, the set of holding parts comprises a jacket extending down to the user's pelvis, the front of which jacket is equipped with at least three rollers mounted loose; as an example, two rollers can be fitted respectively situated at the level of the shoulders and one roller situated at the level of the pelvic region.

Due to the presence of these complementary rollers, starting from the position in which he is on all fours supported by his knees, elbows, feet and hands, the user can lie down fully supine continuing to roll while guiding his movement with his arms; to slow down in this position, he can move his arms to the "snow-plough position", that is to say open his elbows out and press down on them and close up his forearms so as to bring his hands together.

The armor with rollers according to the invention can also enable a user to move by rolling lying on his back.

For this purpose, the back part of the jacket is also equipped with at least three rollers mounted loose; as an example, two rollers can be provided situated respectively at the level of the shoulders and one roller situated at the level of the lumbar region.

Experience has shown that it is preferable to equip this back part with four rollers, i.e. two at the level of the shoulders and two at the level of the lumbar region.

These "dorsal" rollers can advantageously cooperate, according to another feature of the invention, with two buttock support rollers fitted preferably affixed to the bottom part of the dorsal part of the jacket in order to enable the user to raise himself into the seated position.

Thus, from the kneeling position, the user can get onto his back by moving his arms backwards while keeping contact with the ground in order to hold his chest up before rocking on his feet to the seated position and thence to the rear. From this position, he can get up by performing the reverse movement, i.e. sitting down, kneeling, standing up.

According to another feature of the invention, the rollers equipping the front and/or back part of the jacket are located on an abdominal frame and/or on a dorsal frame fitted on the jacket by means of a flexible tie.

It has been proved that the presence of the flexible tie between the frame or frames and the jacket is of a nature to enable the trunk to keep its flexibility in all positions, and to subsequently guarantee optimum freedom of movement for the user.

It should be noted that the user equipped with the armor with rollers according to the invention can, for his movement, use not only horizontal or sloping surfaces, but also inclined planes or vertical surfaces (for example in corridors) on which he can lean with his feet, knees, elbows; hands, back or abdomen.

According to another feature of the invention, the jacket is provided, at the level of the front and/or dorsal part, with at least two rails of obstacles enabling the user to slide on steps or on a balustrade.

On account of the foregoing, the armor with rollers according to the invention enables the user to move in all positions by rolling: sitting, standing, lying on his stomach or on his back, kneeling and on all fours, and to move from one position to another without stopping.

The armor with rollers according to the invention subsequently gives a user's body new geometric and mechanical characteristics and enables him to train the whole of his muscular system, in homogeneous manner, while at the same time developing his balance and his perception of space and movement.

It should be noted that the term "rollers" must be understood in a very general sense and can also designate simple ball-bearings held captive in a cage.

BRIEF DESCRIPTION OF THE DRAWINGS

The features of the armor with rollers which is the object of the invention will be described in greater detail with reference to the accompanying drawings in which.

DETAILED DESCRIPTION OF PREFERRED EMBODIMENTS

Figure 1:
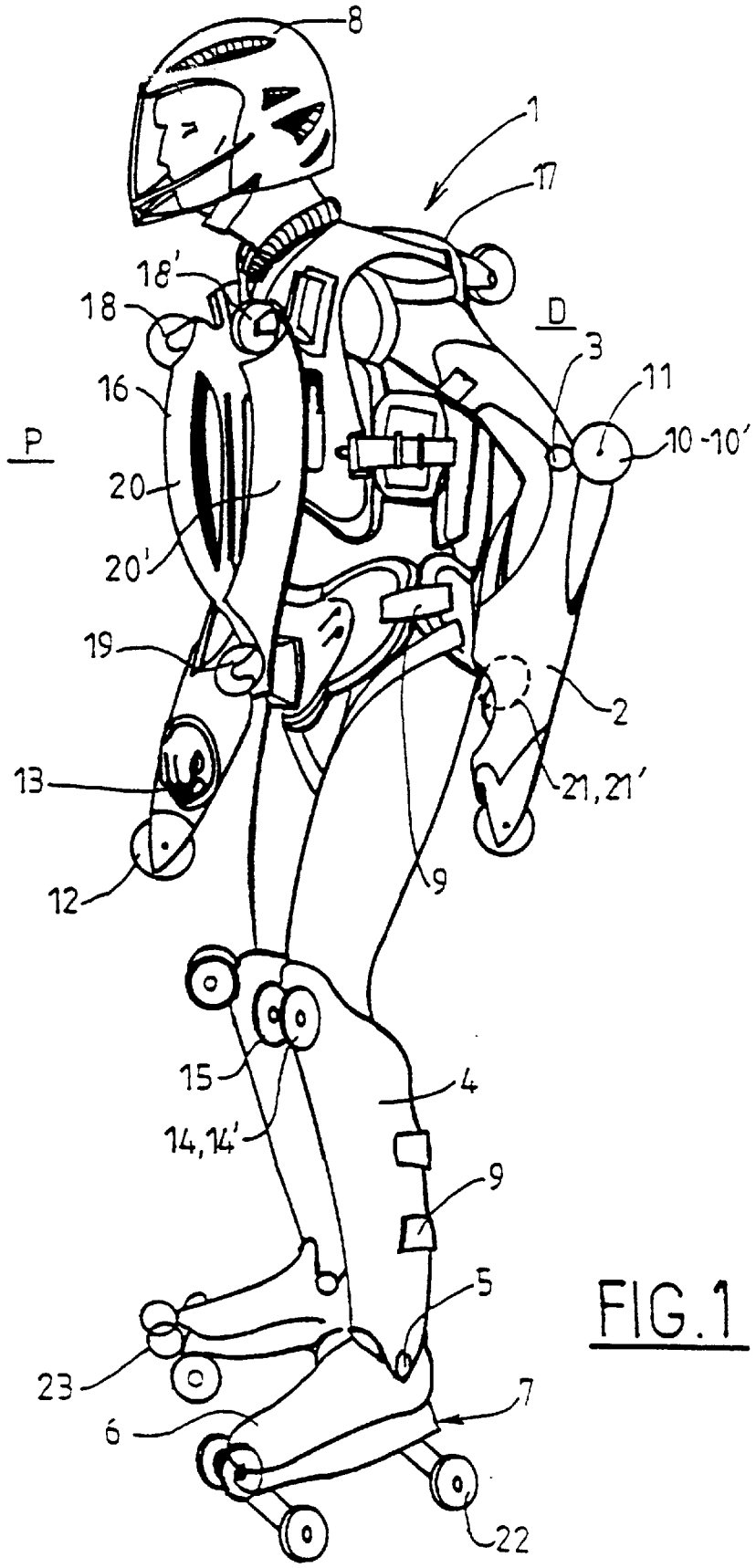
FIG. 1 is a perspective view of a user wearing an armor with rollers according to the invention.

According to FIG. 1, the armor with rollers is essentially formed by a jacket 1, a pair of gauntlets 2 extending up to the user's arm and articulated at the elbow around a pivot 3, and a pair of leg-pads articulated around a pivot 5 on shoes 6 equipped with roller skates 7.

A helmet of conventional type 8 also forms an integral part of this armor.

These different holding elements are made of a sufficiently rigid material and are provided with articulations and with closing elements 9 enabling the user to fit them in place and to fix them onto the associated parts of his trunk or his members.

Each gauntlet 2 is equipped on the one hand at the level of the elbow joint with a pair of rollers 10, 10' mobile around a common fixed rotation axis 11 in such a way as to define an assembly that can be broadly speaking assimilated to conventional roller skates, and on the other hand, beyond the hand, with a fixed roller 12 of larger dimension. A gripping opening 13 is also provided enabling the user to have the use of his hands.

According to FIG. 1, the leg-pads are provided at the level of the knee joint with a pair of rollers 14, 14' fitted around a common fixed rotation axis 15 in such a way as to constitute an assembly that is broadly speaking equivalent to the pairs of rollers 10, 10' with which the gauntlets are equipped at the level of the elbow joint.

According to the example represented in the figures, the skates 7 fitted on the shoes 6 articulated on the leg-pads 4 comprise four rollers 22 grouped in pairs in conventional manner. The skates 7 are moreover equipped with a pair of complementary rollers 23 notably similar to the rollers 22 and situated at the front part of the shoes 6 at the level of the user's toes.

The jacket 1 is for its part equipped respectively at the front part P and at the dorsal part D with an abdominal frame 16 and a dorsal frame 17 both fitted by means of flexible securing parts.

According to FIG. 1, the abdominal frame 16 is equipped with three rollers mounted loose, i.e. two rollers 18, 18' respectively situated at the level of the shoulders and one roller 19 situated at the level of the pelvic region.

Two rails of obstacles 20, 20' are also provided on the abdominal frame 16 enabling the user to slide on steps or on a balustrade.

In a manner which is not represented, the dorsal frame 17 has a configuration to a great extent similar to that of the abdominal frame 16, but is equipped not with three but with four rollers mounted loose, i.e. two rollers situated at the level of the shoulders and also two rollers situated at the level of the lumbar region.

Two buttock support rollers 21, 21' are also provided, represented schematically by a broken line and fitted affixed to the bottom part of the dorsal part of the jacket 1.

Figure 2A:
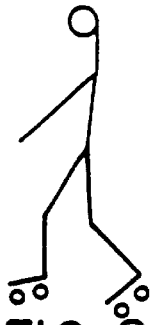
FIGS. 2*a* to 2*k* are drawings showing examples of movements able to be carried out with such an armor.
Figure 2B:
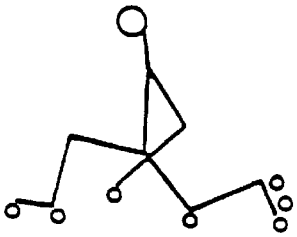
Figure 2C:
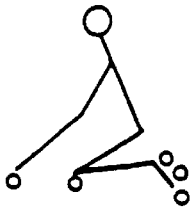
Figure 2D:
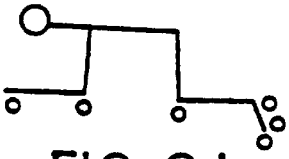
Figure 2E:
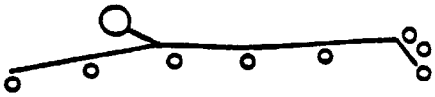

According to FIG. 2*a*, after he has put on the armor with rollers according to the invention, the user can start off his run as if he was on roller skates, then kneel down and place one knee on the ground as in FIG. 2*b*, then his hands and both knees so as to reach the position represented in FIG. 2*c* before spreading himself out onto all fours (FIG. 2*d*) and then lying down in the fully supine position represented in FIG. 2*e*.

Figure 2F:
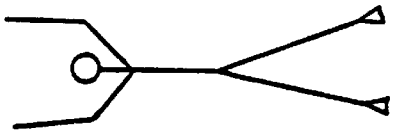
Figure 2G:
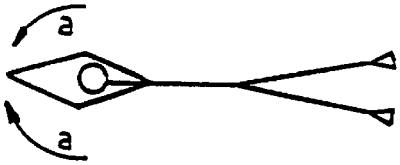

He can then get up while still rolling by performing the same movements as to lie down but in the reverse order. When he wants to slow down from the supine position represented in FIG. 2*e*, the user can perform with his arms a movement derived from the snow-plough well known to skiers by opening his elbows out and pressing down on them while closing up his forearms in the direction of the arrows a (FIG. 2*f*) to bring his hands together according to the position represented in FIG. 2*g*.

Figure 2H:
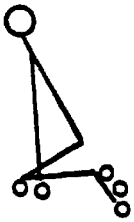
Figure 2J:
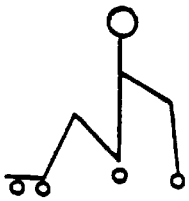
Figure 2I:
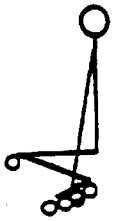
Figure 2K:
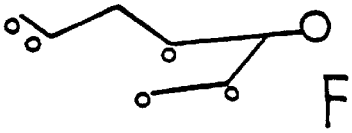

From the kneeling position represented in FIG. 2*c*, the user can also move onto his back by moving his arms to the rear according to FIG. 2*h* while keeping contact with the ground, and then rocking on his feet according to FIG. 2*i* to the seated position represented in FIG. 2*j* before rocking backwards to the supine position according to FIG. 2*k*. Here again, to get up the user has to perform the same movements but in the reverse order.

I claim:

1. An armor with rollers enabling a user to move in all positions by rolling on a hard and smooth surface, while constantly varying his bearing points on the surface, the armor comprising:

a pair of rigid gauntlets each extending from beyond the user's hand to the user's elbow and having a first roller at an end beyond the user's hand and a second roller near the user's elbow; and a pair of rigid leg pads each having a third roller near the user's knee joint.

2. The armor with rollers according to claim 1, wherein each of the pair of rigid leg pads has a pair of third rollers near the user's knee joint, the pair of third rollers having a common rotation axis, and each of the pair of gauntlets has a pair of second rollers near the user's elbow, the pair of second rollers having a common rotation axis.

3. The armor with rollers according to claim 1, further comprising a jacket extending down to the user's pelvis, a front of the jacket having at least three swivel-mounted fourth rollers.

4. The armor with rollers according to claim 3, wherein the jacket further comprises a dorsal part having at least three swivel-mounted fifth rollers.

5. The armor with rollers according to clam 3, wherein the fourth rollers are mounted on an abdominal frame and the fifth rollers are mounted on a dorsal frame, the abdominal frame and the dorsal frame being fitted to the jacket by means of flexible ties.

6. The armor with rollers according to claim 4, wherein the dorsal part of the jacket has fixed to a bottom part thereof two buttock support rollers.

7. The armor with rollers according to claim 3, wherein the jacket has at least two rails mounted to one of the front of the jacket and the dorsal part of the jacket.

8. An armor with rollers enabling a user to move in all positions by rolling on a hard and smooth surface, while constantly varying his bearing points on the ground, the armor comprising:

a pair of rigid leg pads each having a first roller near the user's knee joint;

a pair of shoes fitted with roller skates; and a jacket extending down to the user's pelvis, a front of the jacket having at least three swivel-mounted second rollers.

9. The armor with rollers according to claim 8, wherein the jacket further comprises a dorsal part having at least three swivel-mounted third rollers.

10. The armor with rollers according to claim 9, wherein the second rollers are mounted on an abdominal frame and the third rollers are mounted on a dorsal frame, the abdominal frame and the dorsal frame being fitted to the jacket by means of flexible ties.

11. The armor with rollers according to claim 9, wherein the dorsal part of the jacket has fixed to a bottom part thereof two buttock support rollers.

12. The armor with rollers according to claim 8, wherein the jacket has at least two rails mounted to one of the front of the jacket and the dorsal part of the jacket.

13. The armor with rollers according to claim 6, wherein the buttock support rollers have rotational axes that are fixed with relation to the bottom part of the dorsal part of the jacket.

14. The armor with rollers according to claim 11, wherein the buttock support rollers have rotational axes that are fixed with relation to the bottom part of the dorsal part of the jacket.

* * * * *